US007706564B2

(12) United States Patent
Hachiya et al.

(10) Patent No.: US 7,706,564 B2
(45) Date of Patent: Apr. 27, 2010

(54) DIAPHRAGM AND SPEAKER

(75) Inventors: Satoshi Hachiya, Tendo (JP); Koji Matsumoto, Tendo (JP); Michihiro Ogahara, Kurashiki (JP)

(73) Assignees: Pioneer Corporation, Tokyo (JP); Tohoku Pioneer Corporation, Tendo-shi (JP)

( * ) Notice: Subject to any disclaimer, the term of this patent is extended or adjusted under 35 U.S.C. 154(b) by 1113 days.

(21) Appl. No.: 11/351,274

(22) Filed: Feb. 10, 2006

(65) Prior Publication Data

US 2006/0193488 A1 Aug. 31, 2006

(30) Foreign Application Priority Data

Feb. 10, 2005 (JP) ..... 2005-034526

(51) Int. Cl.
*H04R 25/00* (2006.01)

(52) U.S. Cl. ..... 381/423; 181/167

(58) Field of Classification Search ..... 381/423, 381/426; 525/240; 428/297.4, 297.7; 181/167, 181/169, 170–174
See application file for complete search history.

(56) References Cited

U.S. PATENT DOCUMENTS

| | | | | |
|---|---|---|---|---|
| 2,624,417 | A * | 1/1953 | Brennan | 181/169 |
| 4,308,094 | A * | 12/1981 | Miyoshi et al. | 162/218 |
| 4,410,768 | A * | 10/1983 | Nakamura et al. | 381/423 |
| 4,428,996 | A * | 1/1984 | Miyoshi et al. | 428/198 |
| 6,039,146 | A | 3/2000 | Byun et al. | 181/169 |
| 7,443,998 | B2 * | 10/2008 | Hachiya | 381/426 |

FOREIGN PATENT DOCUMENTS

| | | | |
|---|---|---|---|
| JP | 59-216395 | | 12/1984 |
| JP | 62 185499 | A | 8/1987 |
| JP | 01 181299 | A | 7/1989 |
| JP | 02 057096 | A | 2/1990 |
| JP | 5-284594 | | 10/1993 |
| JP | 8-47083 | | 2/1996 |
| JP | 2681991 | | 8/1997 |
| JP | 2002-38356 | | 2/2002 |
| JP | 2002-69798 | | 3/2002 |
| JP | 2002-78077 | | 3/2002 |

OTHER PUBLICATIONS

European Search Report of Jul. 3, 2008.
Office Action dated Sep. 1, 2009 issued for the corresponding Japanese patent application No. 2005-034526.

* cited by examiner

*Primary Examiner*—Fan Tsang
*Assistant Examiner*—Phylesha Dabney
(74) *Attorney, Agent, or Firm*—Kratz, Quintos & Hanson, LLP

(57) ABSTRACT

A diaphragm (400) of a speaker (100) includes a vibrating member having a substantially thin-plate shape and a base material disposed substantially at the center in a width direction of the vibrating member. The base material is formed by a woof group, a front diagonal thread group, a back diagonal thread group and a warp group, the groups being arranged so as to cross with each other and have axial directions different from each other. Accordingly, tensile strengths of the diaphragm (400) in the axial directions of the groups, i.e., tensile strengths in four directions, can be set to substantially the same. Accordingly, since the number of directions having substantially the same tensile strength is larger than conventional arrangements using triaxial fabrics, occurrence of deformation such as bending of the diaphragm (400) due to resonance can be prevented as compared to the conventional arrangements. Therefore, the speaker (100) capable of vibrating properly can be provided.

8 Claims, 8 Drawing Sheets

DIAPHRAGM AND SPEAKER

BACKGROUND OF THE INVENTION

1. Field of the Invention

The present invention relates to a diaphragm using a substantially filmy base material that is formed by a plurality of linear members and a speaker.

2. Description of Related Art

There has been conventionally known a diaphragm used for a speaker or the like, which employs a so-called triaxial fabric woven by a first, second and third linear members that cross with each other at, for instance, an angle of about 60° (see, for instance, Document 1: Japanese Patent Publication No. 2681991, left column of page 2 to right column of page 3, Document 2: JP-A-2002-78077, right column of page 3, Document 3: JP-A-8-47083, right column of page 2, and Document 4: JP-A-5-284594, right column of page 2).

Document 1 discloses an arrangement in which a prepreg prepared by impregnating a triaxial fabric with a thermosetting resin is placed on a cavity plate having a desired shape. Then, a core is placed on the prepreg to perform compression, heating for setting the resin, and mold the prepreg.

Document 2 discloses a three-layer structure including: a honeycomb core material obtained by forming an aramid fiber material into a honeycomb core; and triaxial fabrics adhered to both sides of the honeycomb core material.

Document 3 discloses an arrangement in which a triaxial fabric as a base material is coated with a phenol resin and a chlorosulfonated polyethylene resin. The base material is then molded with predetermined molding temperature and molding time to have a semicircular cross section.

Document 4 discloses an arrangement in which a triaxial fabric is used as a surround material of a diaphragm, the surround material being coated with a phenol resin and a chlorosulfonated polyethylene resin. The surround material is then heated, molded and cut into a predetermined shape to obtain a surround, the inner side of which is bonded to a diaphragm body.

However, with the arrangements disclosed in Documents 1 through 4, since tensile strength is substantially the same only in three directions as axial directions of the linear members, i.e., 0°, 60° and 120°, tensile strength in a direction of, for instance, 30° might be lower than those of the three directions described above. The difference of the tensile strengths generates deformation of the diaphragm such as bending that causes degradation of sound quality, which might cause music or the like to be output with sound quality different from the original one.

SUMMARY OF THE INVENTION

An object of the present invention is to provide a diaphragm capable of vibrating properly and a speaker.

A diaphragm according to an aspect of the present invention includes: a vibrating member having a substantially thin-plate shape; and a substantially filmy base material that is arranged on a surface of the vibrating member or inside thereof, the base material having a tensile strength equal to or greater than a predetermined strength in four different directions that are parallel to a surface of the filmy base material.

A diaphragm according to another aspect of the present invention includes: a vibrating member having a substantially thin-plate shape; a substantially filmy base material that is arranged on a surface of the vibrating member or inside thereof; and a first linear member, a second linear member, a third linear member and a fourth linear member that are arranged on the base material, in which the first through fourth linear members are arranged so as to cross with each other and have axial directions different from each other.

A speaker according to still another aspect of the present invention includes the diaphragm of the above-described present invention; a voice coil attached to the diaphragm; a magnetic material; and a frame for holding the diaphragm and the magnetic material, the frame including a yoke that forms a magnetic circuit with the magnetic material.

DETAILED DESCRIPTION OF PREFERRED EMBODIMENT(S)

Figure 1:
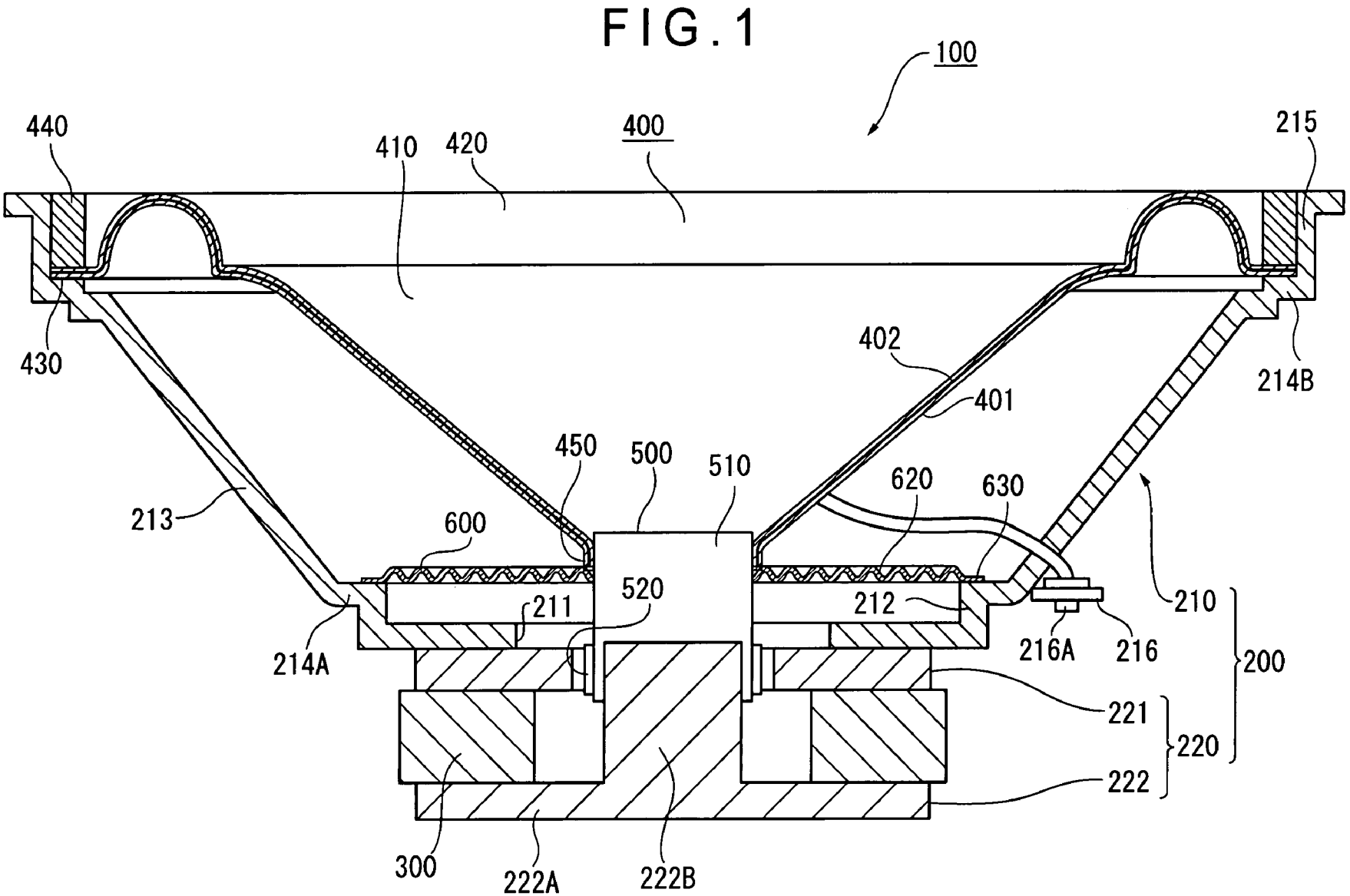
FIG. 1 is a cross section briefly showing an arrangement of a speaker according to an embodiment of the present invention.
Figure 2:
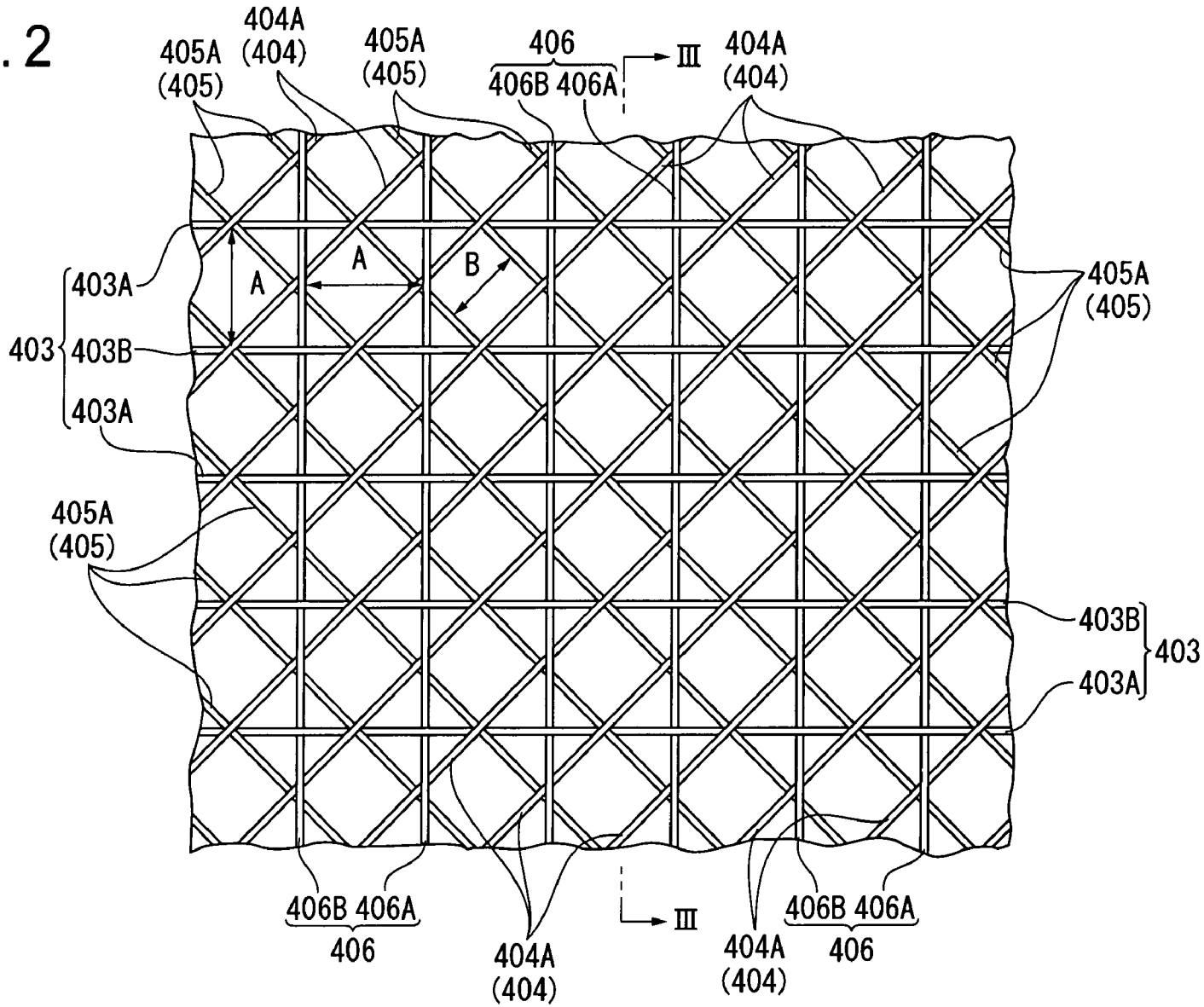
FIG. 2 is a plan view showing a weaving structure of a base material according to the embodiment.
Figure 3:
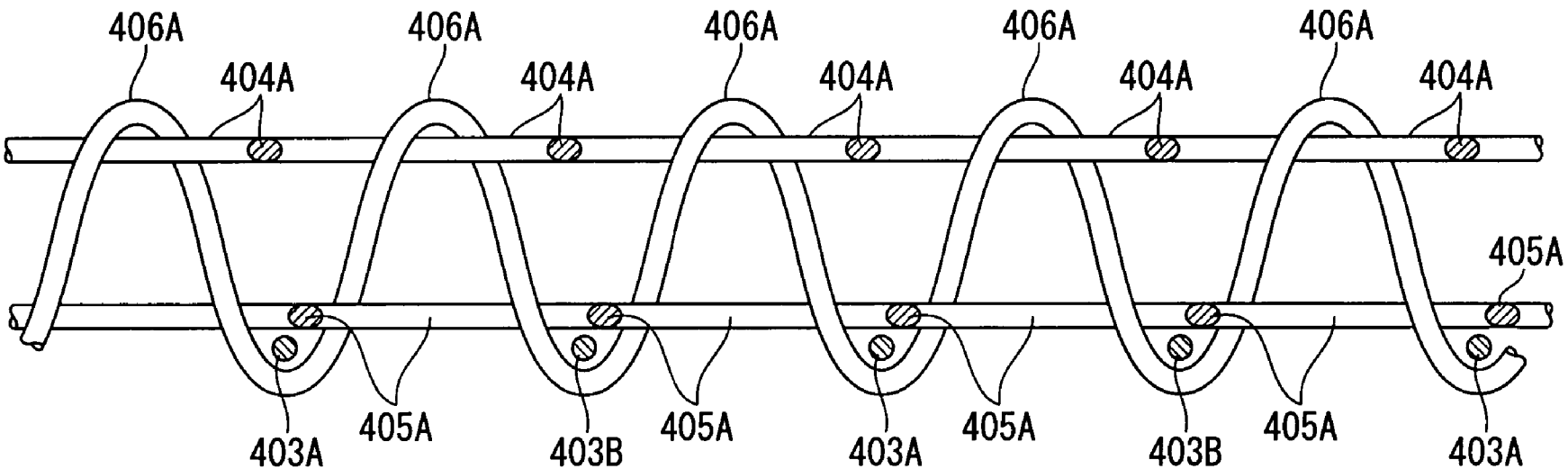
FIG. 3 is a cross section taken along a line III-III of the weaving structure of the base material in FIG. 2 according to the embodiment.

An embodiment of a speaker of the present invention will be described below with reference to the attached drawings. Note that although a cone speaker is exemplified in the present embodiment, the speaker is not limited thereto. FIG. 1 is a cross section briefly showing an arrangement of the speaker according to the embodiment of the present invention. FIG. 2 is a plan view showing a weaving structure of a base material. FIG. 3 is a cross section taken along a line III-III of the weaving structure of the base material in FIG. 2.

[Arrangement of Speaker]

In FIG. 1, the reference numeral 100 denotes a speaker, and the speaker 100 outputs audio data by sound, the audio data being an electrical signal transmitted from an electrically-connected reproducing device The speaker 100 includes a body 200, a magnet (magnetic material) 300, a diaphragm 400, a voice coil bobbin 500 and a protector (not shown).

A frame 210 of the body 200 is made of a hard synthetic resin, a light metal such as an aluminum alloy, or the like, and formed into a substantially dented shape that widens toward one side. A magnetic circuit section 220 that is attached to the frame 210 has a magnetic material such as an iron.

The frame 210 includes a substantially cylindrical bottom section 212 that opens toward the one side and has a substantially circular opening 211 formed substantially at the center of a bottom side. A plurality of bridge sections 213 extend substantially radially from the outer circumferential edge of the bottom section 212, the bridge sections being continuously connected to one another in a manner widening toward a tip side thereof. A first attachment step 214A is provided at a circumferential edge of the bottom section 212 on the widening side of the frame 210, the first attachment step 214A having a first attachment surface that is substantially parallel to the bottom side. The plurality of bridge sections 213 that are continuously connected to one another in a manner widening toward the tip side thereof extend substantially radially from the outer circumferential edge of the first attachment step 214A. A substantially ringed second attachment step 214B that is substantially parallel to the bottom side of the bottom section 212 is provided continuously to the tip of the bridge section 213. A positioning cylindrical section 215 that is substantially coaxial with the bottom section 212 is provided continuously to the outer circumferential edge of the second attachment step 214B. The frame 210 integrally includes a terminal unit 216 having a terminal 216A to which the audio data as the electrical signal is input.

The magnetic circuit section 220 includes a plate 221 and a yoke 222. The plate 221 is formed of a magnetic material to have a substantially ringed shape. The plate 221 is integrally attached to the bottom side of the frame 210 by an adhesive or the like so that the inner circumference of the plate 221 becomes coaxial with the opening 211 of the bottom section 212. The yoke 222 is formed of, for instance, the same material as the plate 221. The yoke 222 includes a substantially discoid platy section 222A and a projection 222B substantially cylindrically projecting toward one side from the center of the platy section 222A. The yoke 222 is integrally attached via the magnet 300 to the plate 221 by an adhesive or the like in such a manner that the platy section 222A and the plate 221 sandwich the magnet 300. With the yoke 222 attached to the plate 221, the outer circumferential surface of the projection 222B faces the inner circumferential surface of the plate 221 with a predetermined gap therebetween, which generates a magnetic gap.

The magnet 300 is formed, for instance, to have a ringed shape, which has pole faces on both end surfaces in an axial direction. As described above, the magnet 300 is sandwiched and attached between the plate 221 and the platy section 222A of the yoke 222 by an adhesive or the like. With the magnet 300 being attached as described above, the projection 222B of the yoke 222 extends through the inner side of the magnet 300 substantially coaxially. Due to the attachment of the magnet 300, the outer circumferential surface of the projection 222B of the yoke 222 and the inner circumferential surface of the plate 221 face each other with different magnetic poles, the magnet 300 and the magnetic circuit section 220 constituting a magnetic circuit.

The diaphragm 400 has a vibrating member 401 that has a substantially thin-plate shape and formed by a paper made of a pulp or resin materials such as a polypropylene, a polyethylene and a polybutylene terephthalate. A substantially filmy base material 402 is provided substantially at the center in a width direction of the vibrating member 401. As shown in FIGS. 2 and 3, the base material 402 is provided as a tetraxial fabric woven by a woof group 403, a front diagonal thread group 404, a back diagonal thread group 405 and a warp group 406.

Specifically, the woof group 403 is arranged substantially at the center in a width direction of the base material 402 as shown in FIG. 3. The woof group 403 includes respective plural sets of first woofs 403A and second woofs 403B which are linearly formed by a material such as a carbon, a PBO (Polypara-phenylene-Benzo-bis-Oxazole), a glass and an aramid. Here, a size of a thread used as the first and second woofs 403A and 403B is preferably 33 to 5010 dtex. Incidentally, the first and second woofs 403A and 403B correspond to a second linear member of the present invention. The first and second woofs 403A and 403B are, as shown in FIG. 2 for instance, arranged alternately in a direction along the surface of the vibrating member 401 (hereinafter, referred to as a plane direction) at an interval A. The interval A is preferably 1.6 to 3.5 mm.

The front diagonal thread group 404 is arranged on the upper side of the woof group 403. The front diagonal thread group 404 has a plurality of front diagonal threads 404A (first linear member) that are linearly formed by, for instance, the same material as the first woofs 403A. A size of a thread used as the front diagonal threads 404A is preferably 33 to 5010 dtex. The front diagonal threads 404A are arranged in the planar direction of the vibrating member 401 at an interval B that is larger than the interval A in such a manner that the front diagonal threads 404A form an angle of 45° with the first woofs 403A. The interval B is preferably 1.3 to 2.48 mm, which is smaller than the interval A.

The back diagonal thread group 405 is arranged on the lower side of the woof group 403. The back diagonal thread group 405 has a plurality of back diagonal threads 405A (third linear member) that are linearly formed by, for instance, the same material as the first woofs 403A. A size of a thread used as the back diagonal threads 405A is preferably 33 to 5010 dtex. The back diagonal threads 405A are arranged in the planar direction of the vibrating member 401 at the interval B in such a manner that the back diagonal threads 405A form the substantially right angles with the front diagonal threads 404A.

The warp group 406 has respective plural sets of first warps 406A and second warps 406B that are linearly formed by, for instance, the same material as the first woofs 403A. Here, a size of a thread used as the first and second warps 406A and 406B is preferably 33 to 5010 dtex. Incidentally, the first and second warps 406A and 406B correspond to a fourth linear member of the present invention. The first and second warps 406A and 406B are arranged alternately at the interval A in the planar direction of the vibrating member 401 in such a manner that the first and second warps 406A and 406B form the substantially right angles with the first woofs 403A. The first warp 406A extends so as to alternately pass the lower side of the first woof 403A and the upper side of the front diagonal thread 404A. The second warp 406B extends so as to alternately pass the upper side of the first woof 403A and the lower side of the back diagonal thread 405A. In other words, the first and second warps 406A and 406B are arranged so that back and front sides of the base material 402 have a common weaving structure.

It should be noted that although FIG. 3 shows a state where the front diagonal thread 404A is arranged away from the first and second woofs 403A and 403B, when the base material 402 is provided on the vibrating member 401, the base material 402 is provided to the vibrating member 401 so that both ends (not shown) of the first and second warps 406A and 406B are stretched in a right-and-left direction. Thus, the front diagonal thread 404A will contact with the first and second woofs 403A and 403B and the back diagonal thread 405A as well as the first warp 406A. Also, the back diagonal thread 405A will contact with the first and second woofs 403A and 403B and the front diagonal thread 404A as well as the second warp 406B.

The diaphragm 400 has a vibrating section 410 having a substantially cone shape with a top thereof being cut out, the vibrating section 410 widening toward one side. Provided continuously on the outer circumferential edge of the vibrating section 410 is an edge section 420 that is curved and projected toward the side to which the vibrating section 410 widens, the edge section 420 having a substantially U-shaped cross section. Further, provided on the outer circumferential edge of the edge section 420 is an attachment flange 430 that projects outward like a flange, the attachment flange 430 being attached to the attachment surface of the second attachment step 214B of the frame 210 by an adhesive or the like in a manner being sandwiched between the attachment surface and a ringed attachment member 440, thereby being supported by the frame 210. An attaching section 450 that is arranged continuously and substantially cylindrically is provided on the inner circumferential edge of the diaphragm 400. Incidentally, the edge section 420 may be a separate component which is attached in the vicinity of the outer circumferential edge of the vibrating section 410 by an adhesive or the like so that the diaphragm 400 is arranged continuously.

The voice coil bobbin 500 is integrally provided to the diaphragm 400. The voice coil bobbin 500 includes a substantially cylindrical coil bobbin 510 and a voice coil 520 wound around the outer circumferential surface of the coil bobbin 510.

The coil bobbin 510 is formed in a substantially cylindrical shape with an aluminum bearing metal such as an aluminum alloy as a metal that contains an aluminum as a main component. The coil bobbin 510 is so formed that the outer diameter thereof is substantially the same as the inner diameter of the attaching section 450 of the diaphragm 400, one end in an axial direction of which is integrally attached to the attaching section 450 by an adhesive or the like. Incidentally, a domy dust cap may be integrally adhered, by an adhesive or the like, to an end of the coil bobbin 510 for closing an end surface thereof, the end being located on the side to which the diaphragm 400 widens.

The voice coil 520 is wound around the outer circumferential surface of the other end in the axial direction of the coil bobbin 510. The voice coil 520 is formed by winding a conductive wire (not shown) provided with a heatproof treatment around the coil bobbin 510.

In the voice coil bobbin 500, the heatproof conductive wire is wound around the coil bobbin 510 and heated, so that adjacent rows of the conductive wire are fused to each other and further fused to the coil bobbin 510, whereby the voice coil 520 is wound around the coil bobbin 510. Both ends of the conductive wire of the voice coil 520 are pulled out and connected to the terminal 216A of the terminal unit 216 provided on the frame 210, the both ends serving as input terminals of the audio data.

A substantially discoid attachment supporter 600, which is a so-called dumper, is integrally provided to the voice coil bobbin 500. The attachment supporter 600 has a cylindrical section (not shown) that is substantially cylindrical, to the center of which the coil bobbin 510 is inserted. The inner circumferential surface of the cylindrical section is integrally attached to the outer circumferential surface of the coil bobbin 510 by an adhesive or the like. The attachment supporter 600 is provided continuously with a movable section 620 at an end in an axial direction of the cylindrical section, the movable section 620 having a flange-like shape and waving in a radial direction thereof. A flange section 630 is continuously provided to and projected from the outer circumferential edge of the movable section 620, the flange section 630 being attached to the first attachment step 214A of the frame 210 by an adhesive or the like. By attaching the flange section 630 of the attachment supporter 600 to the first attachment step 214A of the frame 210 while attaching the attachment flange 430 of the edge section 420 of the diaphragm 400 to the second attachment step 214B of the frame 210, the diaphragm 400 with the voice coil bobbin 500 being integrally attached thereto is disposed in the frame 210. With this disposition, the voice coil 520 is positioned in the magnetic gap.

The protector is formed of, for instance, a synthetic resin or a metal to have a shape like a mesh, which is attached to the positioning cylindrical section 215 of the frame 210 in a manner covering a side to which the diaphragm 400 widens. The attachment of the protector may be performed in any manner such as fitting and screwing as well as using an adhesive or the like. Alternatively, the speaker 100 may not be provided with the protector.

[Advantages of Speaker]

In the above-described embodiment, the diaphragm 400 of the speaker 100 includes the vibrating member 401 having a substantially thin-plate shape and the base material 402 disposed substantially at the center in the width direction of the vibrating member 401. The base material 402 is formed by the woof group 403, the front diagonal thread group 404, the back diagonal thread group 405 and the warp group 406, the groups being arranged so as to cross with each other and have axial directions different from each other. Thus, tensile strengths in the axial directions of the woof group 403, the front diagonal thread group 404, the back diagonal thread group 405 and the warp group 406 in the diaphragm 400 (i.e., tensile strengths in four directions) can be substantially the same. Accordingly, the number of directions having substantially the same tensile strength becomes larger than conventional arrangements using triaxial fabrics, occurrence of deformation such as bending of the diaphragm 400 due to resonance can be prevented as compared to the conventional arrangements. Therefore, the diaphragm 400 capable of vibrating properly can be provided. Due to the proper vibration of the diaphragm 400, the speaker 100 can output music, for instance, with sound quality closer to the original one without degradation of the sound quality as compared to the conventional arrangements.

It is so arranged that the front diagonal thread 404A forms an angle of about 45° with the first warp 406A, that the first woof 403A forms an angle of about 90° with the first warp 406A, and that the back diagonal thread 405A forms an angle of about 135° with the first warp 406A. Thus, directions having substantially the same tensile strength can be set in about every 45°, namely every common angle. Accordingly, differences in deformation degree of the diaphragm 400 can be decreased as compared to an arrangement in which directions having substantially the same tensile strength are not set substantially at every common angle, e.g., an arrangement in which the front diagonal thread 404A forms an angle of about 30° with the first warp 406A, the first woof 403A forms an angle of about 90° with the first warp 406A and the back diagonal thread 405A forms an angle of about 150° with the first warp 406A. Therefore, the diaphragm 400 capable of vibrating more properly can be provided. Also, the speaker 100 can output music with sound quality even closer to the original one.

The base material 402 is formed by the tetraxial fabric that is woven by the woof group 403, the front diagonal thread group 404, the back diagonal thread group 405 and the warp group 406. Hence, the base material 402 can be handled as a single member in a manufacturing step of the diaphragm 400, thereby facilitating the handle of the base material 402 as compared to an arrangement in which, for instance, layers of the woof group 403, the front diagonal thread group 404, the back diagonal thread group 405 and the warp group 406 are simply laminated in sequence. Therefore, manufacturing of the diaphragm 400 can be facilitated.

It is so arranged that the front diagonal thread 404A contacts with the first warp 406A, the first woof 403A and the back diagonal thread 405A, in other words, the front diagonal thread 404A contacts with the first warp 406A, the first woof 403A and the back diagonal thread 405A that are arranged in three different directions. Hence, the number of contact points on the axial direction of the front diagonal thread 404A contacting with the other threads in the other directions can be increased as compared to a conventional arrangement employing the triaxial fabric as a base material (hereinafter, threads arranged in different directions for forming the triaxial fabric are referred to as a woof, a warp and a diagonal thread, respectively), where, for instance, the diagonal thread is arranged so as to contact with the woof and the warp, in other words, the diagonal thread is arranged so as to contact with the other threads arranged in two different directions. Thus, with the increased contact points, occurrence of undesired resonance of the front diagonal thread 404A during vibration of the diaphragm 400 can be prevented as compared to the conventional arrangement, thereby allowing the speaker 100 to output, for instance, music with sound quality closer to the original one.

Further, the first and second warps 406A and 406B are arranged so that the back and front sides of the base material 402 have a common weaving structure. Accordingly, in the manufacturing step of the diaphragm 400, an operator can handle the base material 402 without paying attention to whether it is the front side or the back side. Therefore, manufacturing of the diaphragm 400 can be facilitated.

Modification of Embodiment

Incidentally, the present invention is not limited to the above-described embodiment, but includes the following modifications as long as the object of the present invention can be achieved.

The woof group 403, the front diagonal thread group 404, the back diagonal thread group 405 and the warp group 406 may be arranged so that the directions having substantially the same tensile strength are not set at every common angle. For instance, it may be so arranged that the front diagonal thread 404A forms an angle of about 30° with the first warp 406A, that the first woof 403A forms an angle of about 90° with the first warp 406A, and that the back diagonal thread 405A forms an angle of about 150° with the first warp 406A. Even with such arrangement, occurrence of the deformation such as bending due to resonance can be prevented as compared to the conventional arrangements using the triaxial fabrics, a diaphragm vibrating properly can be provided.

The base material 402 may not be formed as a tetraxial fabric, but may be formed as a tetraxial braided fabric in which layers of the woof group 403, the front diagonal thread group 404, the back diagonal thread group 405 and the warp group 406 are laminated in sequence. With such arrangement, a step for weaving the base material 402 can be omitted, thereby easily manufacturing the base material. Further, in such arrangement, by fixing the woof group 403, the front diagonal thread group 404, the back diagonal thread group 405 and the warp group 406 to each other by an adhesive or the like, the handling of the base material can be facilitated.

Although the first and second warps 406A and 406B entwine only with the first woof 403A in the above description, the first and second warps 406A and 406B may also entwine with the second woof 403B so that the back and front sides of the base material 402 have a common weaving structure. Specifically, it may be so arranged that the first warp 406A alternately passes the lower side of the first woof 403A, the upper side of the front diagonal thread 404A, the lower side of the second woof 403B and the upper side of the front diagonal thread 404A, and that the second warp 406B alternately passes the upper side of the first woof 403A, the lower side of the back diagonal thread 405A, the upper side of the second woof 403B and the lower side of the back diagonal thread 405A. Even with such arrangement, the diaphragm 400 capable of vibrating properly can be provided, owing to the advantages similar to those of the above-described embodiment.

Figure 4:
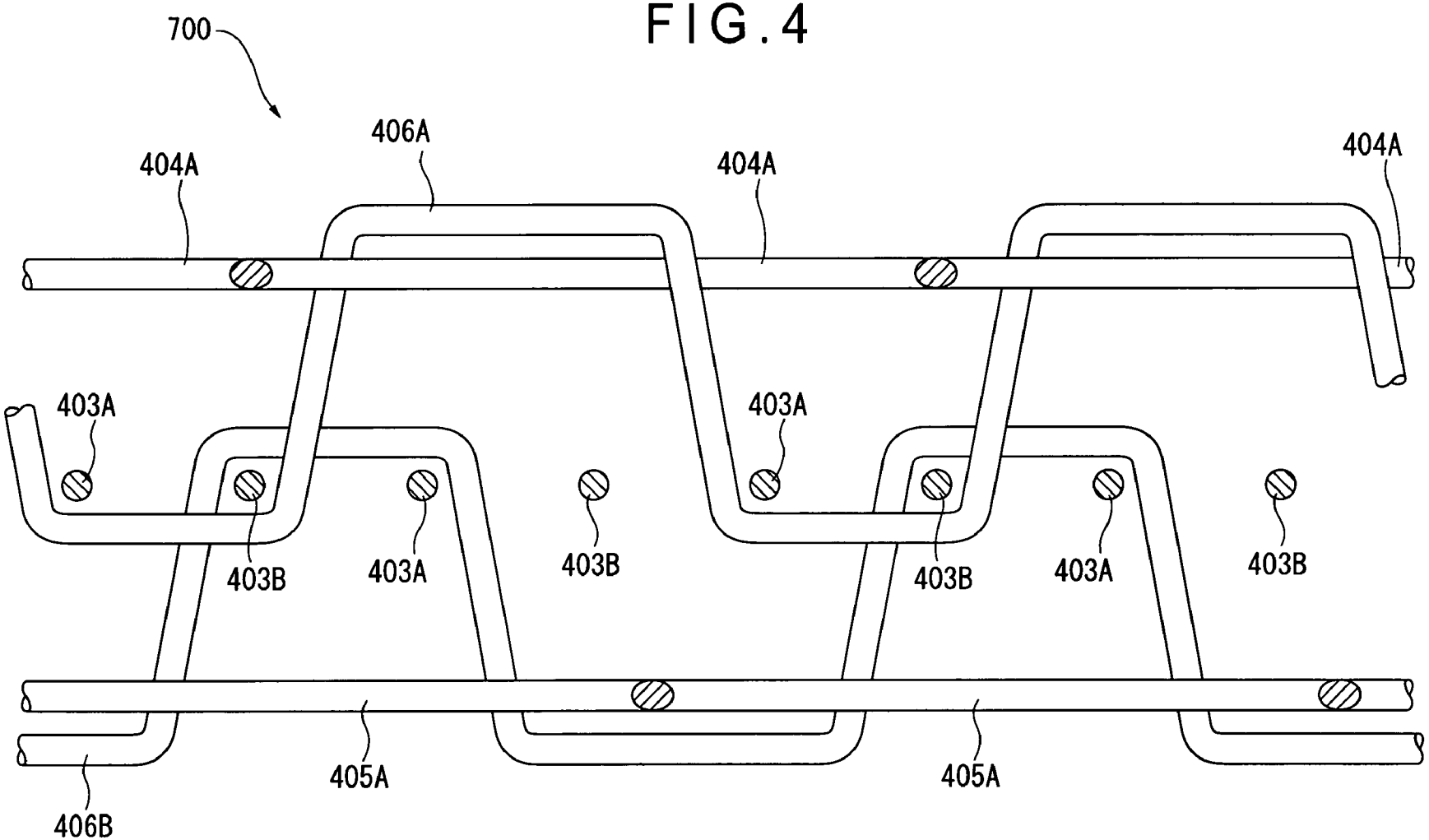
FIG. 4 is a cross section of a weaving structure of a base material according to another embodiment of the present invention.

A base material 700 having a common weaving structure on the back and front sides thereof as shown in FIG. 4 may be employed in place of the base material 402. The base material 700 is arranged so that the first warp 406A extends so as to alternately pass the lower sides of the first and second woofs 403A and 403B and the upper side of the front diagonal thread 404A. The second warp 406B extends so as to alternately pass the upper sides of the second and first woofs 403B and 403A and the lower side of the back diagonal thread 405A. With such arrangement, the diaphragm capable of vibrating properly can be provided, owing to the advantages similar to those of the above-described embodiment.

Figure 5:
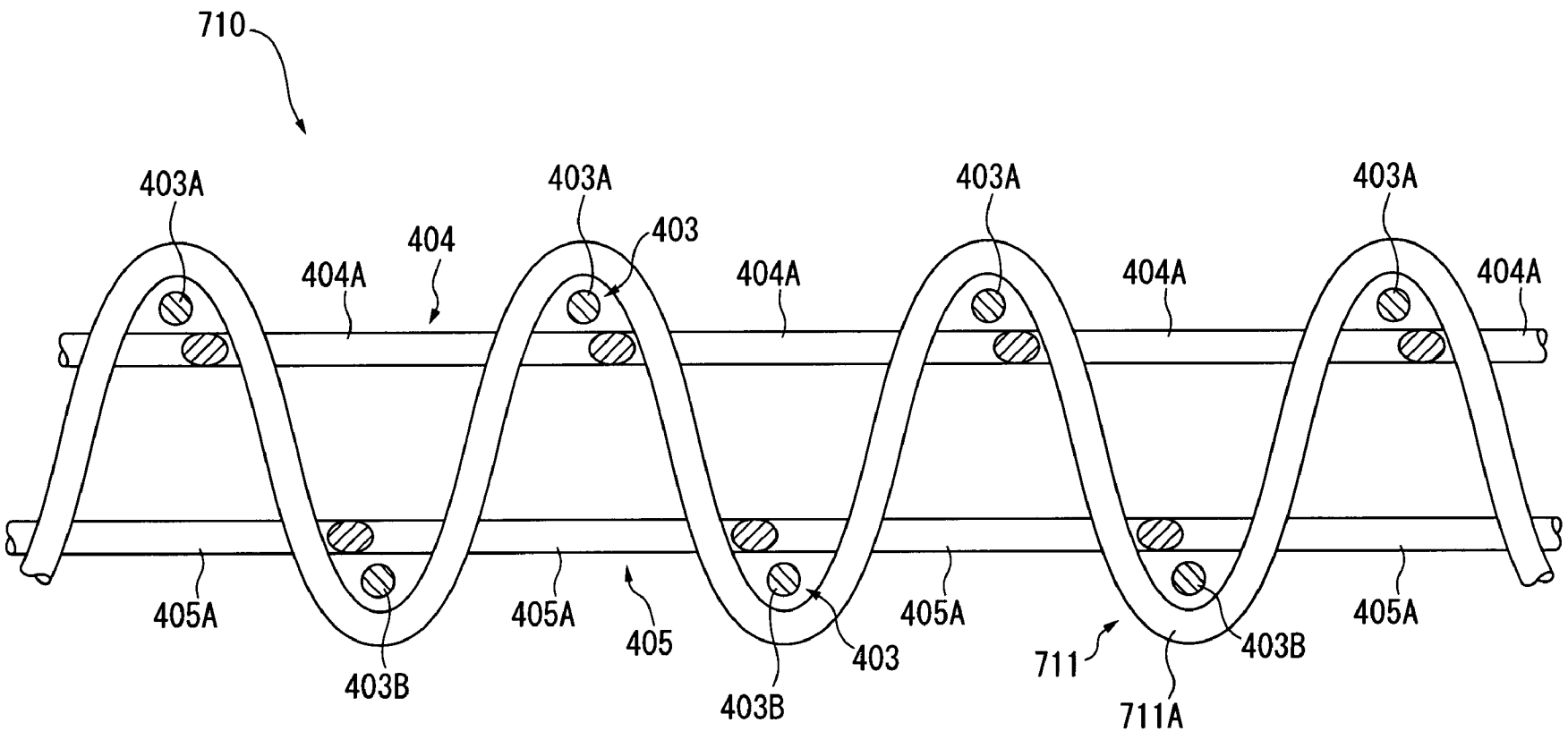
FIG. 5 is a cross section of a weaving structure of a base material according to still another embodiment of the present invention.

As another arrangement, a base material 710 having a common weaving structure on the back and front sides thereof as shown in FIG. 5 may be employed in place of the base material 402. The base material 710 includes the woof group 403, the front diagonal thread group 404, the back diagonal thread group 405 and a warp group 711. The first woofs 403A are arranged on the upper side in a width direction of the base material 710. The second woofs 403B are arranged on the lower side in a width direction of the base material 710. The front diagonal threads 404A are arranged on the lower side of the first woofs 403A. The back diagonal threads 405A are arranged on the upper side of the second woofs 403B and the lower side of the front diagonal threads 404A. The warp group 711 has a plurality of warps 711A (fourth linear member) arranged so as to form the substantially right angles with the first and second woofs 403A and 403B at a predetermined interval. The warp 711A extends so as to alternately pass the upper sides of the first woof 403A and the front diagonal thread 404A and the lower sides of the second woof 403B and the back diagonal thread 405A. With such arrangement, the diaphragm capable of vibrating properly can be provided, owing to the advantages similar to those of the above-described embodiment.

Figure 6:
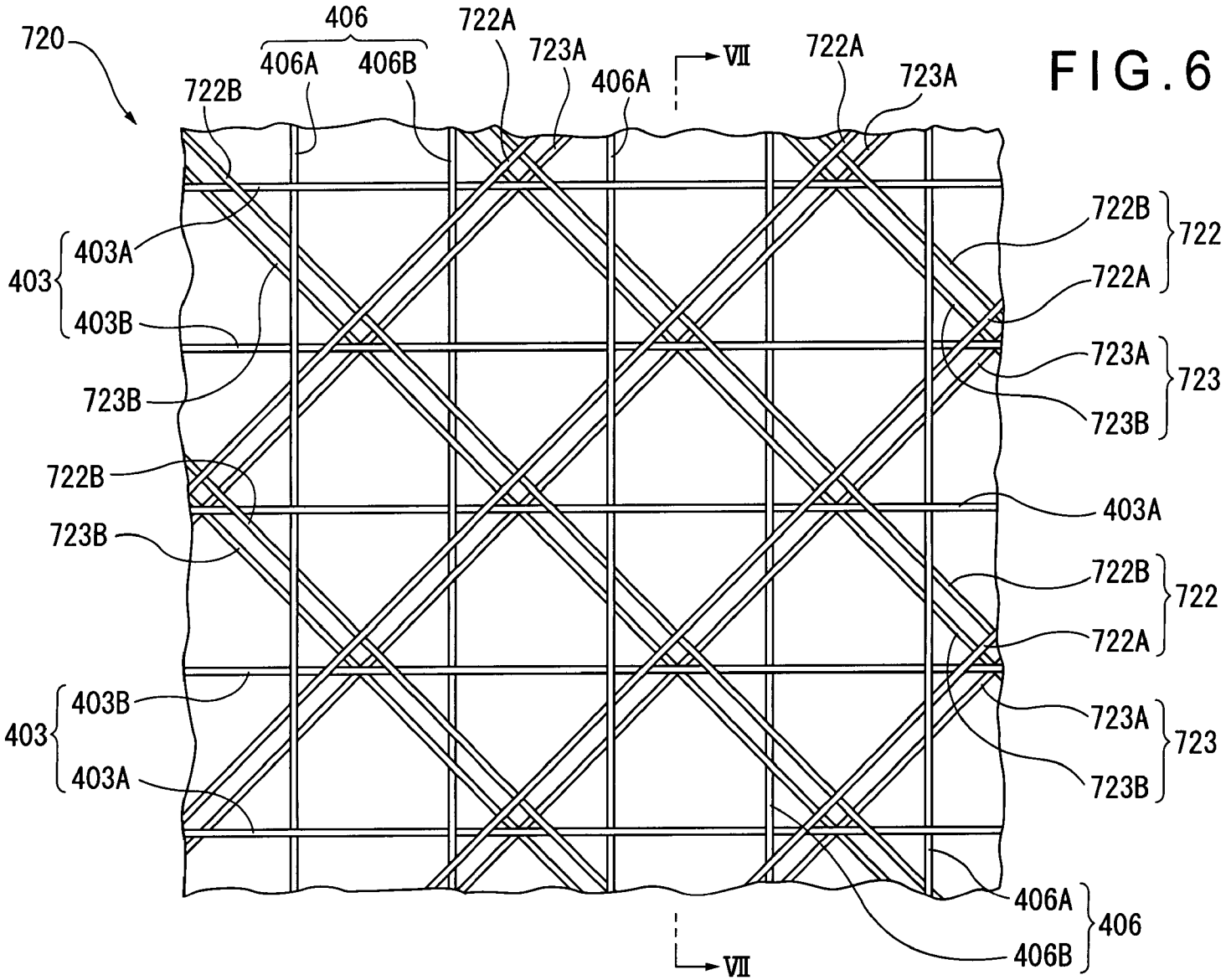
FIG. 6 is a cross section of a weaving structure of a base material according to a further embodiment of the present invention.
Figure 7:
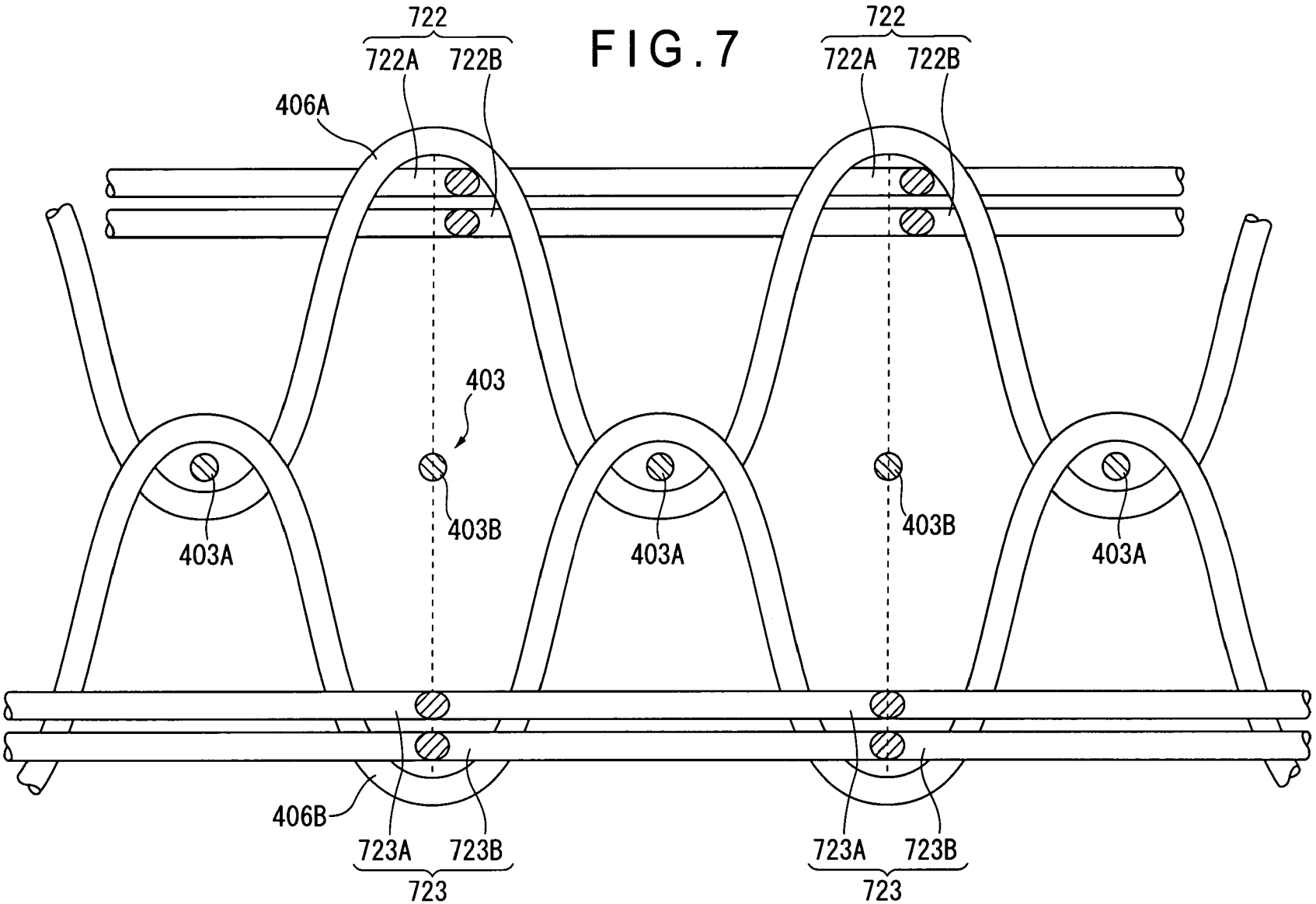
FIG. 7 is a cross section taken along a line VII-VII of the weaving structure of the base material in FIG. 6 according to the above embodiment.

As still another arrangement, a base material 720 having a common weaving structure on the back and front sides thereof as shown in FIGS. 6 and 7 may be employed in place of the base material 402. FIG. 7 is a cross section taken along a line VII-VII of the weaving structure of the base material in FIG. 6. The base material 720 is formed as a tetraxial fabric woven by the woof group 403, a front diagonal thread group 722, a back diagonal thread group 723 and the warp group 406. FIGS. 6 and 7 show that a number of threads of the front and back diagonal thread groups per a predetermined area is larger than the number of threads of the warp and the woof groups per the predetermined area.

As shown in FIG. 7, the front diagonal thread group 722 is arranged on the upper side of the woof group 403. The front diagonal thread group 722 includes respective plural sets of first front diagonal threads 722A and second front diagonal threads 722B. Here, the first and second front diagonal threads 722A and 722B correspond to a first linear member of the present invention. As shown in FIG. 6, the first front diagonal threads 722A are arranged so as to form an angle of about 45° with the first woofs 403A. The second front diagonal threads 722B are arranged on the lower side of the first front diagonal threads 722A so as to form the substantially right angle with the first front diagonal threads 722A. The back diagonal thread group 723 is arranged on the lower side of the woof group 403. The back diagonal thread group 723 includes respective plural sets of first back diagonal threads 723A and second back diagonal threads 723B. Here, the first and second back diagonal threads 723A and 723B correspond to a third linear member of the present invention. The first back diagonal threads 723A are arranged substantially in parallel to the first front diagonal threads 722A. The second back diagonal threads 723B are arranged on the lower side of the first back diagonal threads 723A so as to be substantially in parallel to the second front diagonal threads 722B. The first warp 406A extends so as to alternately pass the lower side of the first woof 403A and the upper sides of the first and second front diagonal threads 722A and 722B. The second warp 406B extends so as to alternately pass the upper side of the first woof 403A and the lower sides of the first and second back diagonal threads 723A and 723B. With such arrangement, the diaphragm capable of vibrating properly can be provided, owing to the advantages similar to those of the above-described embodiment.

Figure 8:
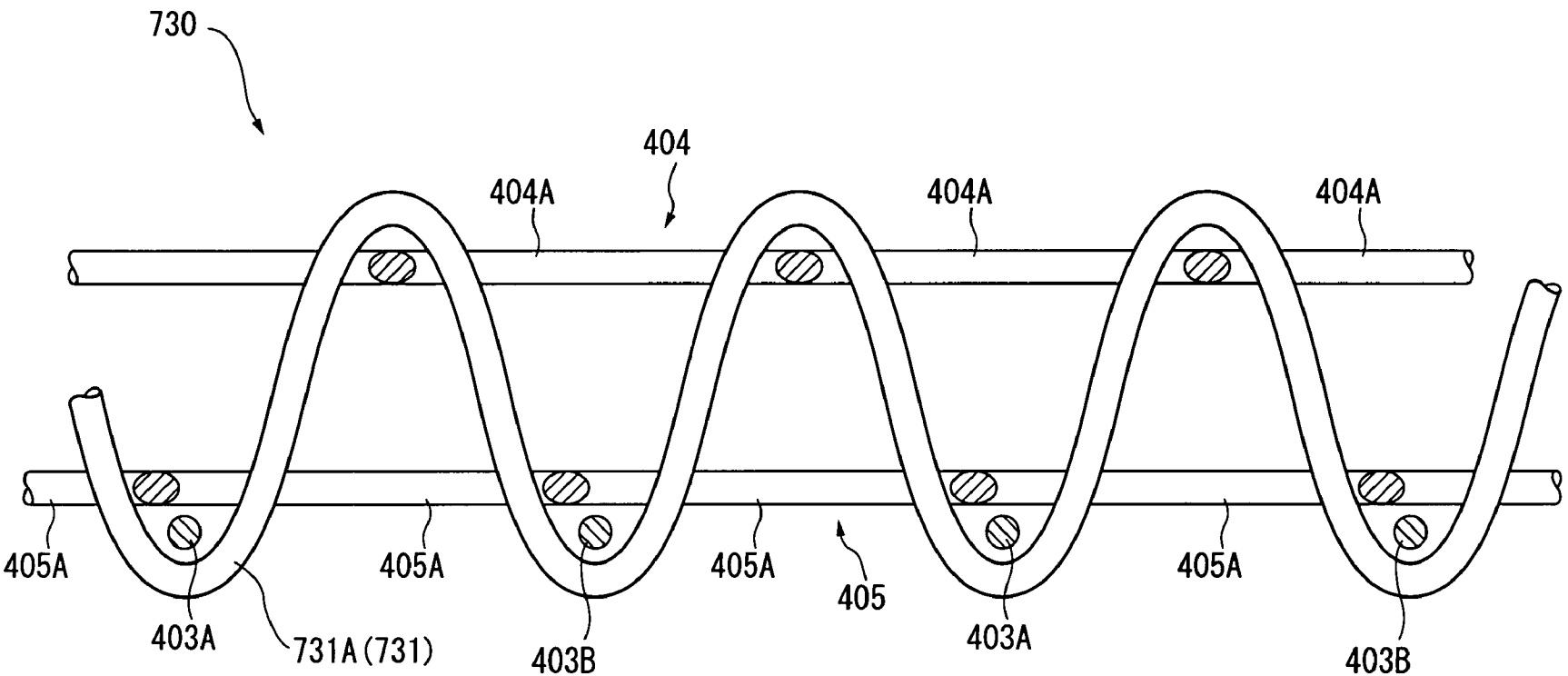
FIG. 8 is a cross section of a weaving structure of a base material according to a still further embodiment of the present invention.

As further arrangement, a base material 730 having different weaving structures on the back and front sides thereof as shown in FIG. 8 may be employed in place of the base material 402. The base material 730 includes the woof group 403, the front diagonal thread group 404, the back diagonal thread group 405 and a warp group 731. The first and second woofs 403A and 403B are arranged on the lower side in a width direction of the base material 730. The front diagonal threads 404A are arranged on the upper side of the first woofs 403A. The back diagonal threads 405A are arranged between the first woofs 403A and the front diagonal threads 404A. The warp group 731 has a plurality of warps 731A (fourth linear member) arranged so as to form the substantially right angle with the first woofs 403A at a predetermined interval. The warp 731A extends so as to alternately pass the lower sides of the first woof 403A and the back diagonal thread 405A, the upper side of the front diagonal thread 404A, the lower sides of the second woof 403B and the back diagonal thread 405A and the upper side of the front diagonal thread 404A. With such arrangement, the diaphragm capable of vibrating properly can be provided, owing to the advantages similar to those of the above-described embodiment.

Specific structures and procedures in implementing the present invention can be changed to another structures and the like as long as the object of the present invention can be achieved.

Advantages of Embodiment

In the above-described embodiment, the diaphragm 400 of the speaker 100 includes the vibrating member 401 having a substantially thin-plate shape and the base material 402 disposed substantially at the center in the width direction of the vibrating member 401, the base material 402 having substantially the same tensile strength in four different directions. Accordingly, since the number of directions having substantially the same tensile strength is larger than conventional arrangements using triaxial fabrics, occurrence of deformation such as bending of the diaphragm 400 due to resonance can be prevented as compared to the conventional arrangements. Therefore, the diaphragm 400 capable of vibrating properly can be provided.

The base material 402 is formed by the woof group 403, the front diagonal thread group 404, the back diagonal thread group 405 and the warp group 406, the groups being arranged so as to cross with each other and have axial directions different from each other. Thus, tensile strengths in the axial directions of the woof group 403, the front diagonal thread group 404, the back diagonal thread group 405 and the warp group 406 of the diaphragm 400 (i.e., tensile strengths in four directions) can be substantially the same. Accordingly, since the number of directions having substantially the same tensile strength is larger than conventional arrangements using triaxial fabrics, occurrence of deformation such as bending of the diaphragm 400 due to resonance can be prevented as compared to the conventional arrangements. Therefore, the diaphragm 400 capable of vibrating properly can be provided.

The priority application Number JP2005-034526 upon which this patent application is based is hereby incorporated by reference.

What is claimed is:

1. A diaphragm, comprising:

a vibrating member having a substantially thin-plate shape; and a base material that is arranged on a surface of the vibrating member or inside thereof, the base material consisting essentially of linear members arranged in groups, the groups consisting of a first group, a second group, a third group, and a fourth group, each of the four groups consisting essentially of a respective coparallel plurality of the linear members, the linear members of the first, the second, the third, and the fourth groups, at every place on the base material, extending respectively in a first direction, a second direction, a third direction, and a fourth direction relative to one another, the first, the second, the third, and the fourth directions being all different from each other.

2. A diaphragm according to claim 1, wherein the first, the second, the third, and the fourth groups are so arranged that the first through third directions respectively form angles of substantially 45°, 90° and 135° with the fourth direction.

3. A diaphragm according to claim 2, wherein the first group of the plurality of linear members provides a front diagonal thread group, the third group of the plurality of linear members provides a back diagonal thread group that is arranged substantially orthogonal to the front diagonal thread group, the second group of the plurality of linear members provides a woof group, and the fourth group of the plurality of linear members provides a warp group that is arranged substantially orthogonal to the woof group.

4. A diaphragm according to claim 3, wherein the number of threads of the front and back diagonal thread groups per a predetermined area is larger than the number of threads-of the warp and the woof groups per the predetermined area.

5. The diaphragm according to claim 4, wherein the first through third directions respectively form angles of 45°, 90° and 135° with the fourth direction.

6. A diaphragm according to claim 1, wherein the base material is a tetraxial fabric woven with the first, the second, the third, and the fourth groups of the plurality of linear members that respectively extend in the first, the second, the third, and the fourth directions.

7. A diaphragm according to claim 1, each of the plurality of linear members is provided by arranging a plurality of threads in a substantially filmy shape.

8. A speaker, comprising a diaphragm;

a voice coil attached to the diaphragm;

a magnetic material; and a frame for holding the diaphragm and the magnetic material, the frame including a yoke that forms a magnetic circuit with the magnetic material, wherein the diaphragm comprises:

a vibrating member having a substantially thin-plate shape; and a base material that is arranged on a surface of the vibrating member or inside thereof, the base material consisting essentially of linear members arranged in groups, the groups consisting of a first group, a second group, a third group, and a fourth group, each of the four groups consisting essentially of a respective coparallel plurality of the linear members, the linear members of the first, the second, the third, and the fourth groups, at every place on the base material, extending respectively in a first direction, a second direction, a third direction, and a fourth direction relative to one another, the first, the second, the third, and the fourth directions being all different from each other.

* * * * *